US005283223A

United States Patent [19]

Neumann et al.

[11] Patent Number: 5,283,223

[45] Date of Patent: Feb. 1, 1994

[54] DYE-DONOR BINDER FOR THERMAL DYE TRANSFER SYSTEMS

[75] Inventors: Stephen M. Neumann; Mark P. Guittard, both of Rochester, N.Y.

[73] Assignee: Eastman Kodak Company, Rochester, N.Y.

[21] Appl. No.: 980,895

[22] Filed: Nov. 24, 1992

[51] Int. Cl.[5] ..... B41M 5/035; B41M 5/38

[52] U.S. Cl. ..... 503/227; 428/198; 428/478.2; 428/913; 428/914; 430/201; 430/945

[58] Field of Search ..... 8/471; 428/195, 478.2, 428/913, 914; 430/200, 201, 945; 503/227

[56] References Cited

U.S. PATENT DOCUMENTS

| | | | |
|---|---|---|---|
| 5,017,547 | 5/1991 | DeBoer | 503/227 |
| 5,110,848 | 5/1992 | Igarashi | 524/30 |
| 5,214,023 | 5/1993 | Aono | 503/227 |

FOREIGN PATENT DOCUMENTS

| | | | |
|---|---|---|---|
| 61-262190 | 11/1986 | Japan | 503/227 |

*Primary Examiner*—B. Hamilton Hess
*Attorney, Agent, or Firm*—Harold E. Cole

[57] ABSTRACT

This invention relates to a dye-donor element for thermal dye transfer comprising a support having thereon a dye layer comprising an image dye dispersed in a binder, and wherein the binder has been coated from an aqueous solution and consists essentially of a hydrophilic polymer which has been set.

15 Claims, No Drawings

DYE-DONOR BINDER FOR THERMAL DYE TRANSFER SYSTEMS

This invention relates to the use of a hydrophilic binder in the dye-donor element of a thermal dye transfer system.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

In U.S. Pat. No. 5,017,547, there is a disclosure of typical polymeric material binders for dye-donor elements of laser-induced thermal dye transfer systems. The dye layer may be produced by casting a solvent solution of organic dye which also contains a mutually soluble binder. However, there is a problem with using organic solvents in such coatings in that they are harmful if released to the environment.

In JP 61/262,190, there is a disclosure of aqueous dispersions of binders for a dye-donor element for laser thermal dye transfer systems. These binders include natural resins, such as gum arabic, dextrin, casein, cellulosic resins, as well as polyvinyl alcohols and polyvinyl acetates. There is a problem with these dispersions, however, in that they give a high mottle pattern, as will be shown by comparative tests hereafter, which in turn will give poor transfers. The more uniformly an image dye is dispersed throughout a dye layer, the higher the quality of the resulting transfer image.

In U.S. Pat. No. 5,110,848, there is a disclosure of a wet dispersion process for dispersing particles of an organic compound in water. The materials which are to be dispersed are color formers or color developers, and not image dyes. These materials are dispersed in water using a mixture of a water-soluble high molecular weight compound, such as polyvinyl alcohol or gelatin, and a particular copolymer, and then heat-treated at a temperature above 30° C. There is no disclosure in that patent of using the water-soluble high molecular weight compound alone as the binder, or of using a material which has been set.

It is an object of this invention to provide an aqueous dispersion binder for a dye-donor element which does not have high mottle. It is another object of the invention to provide an aqueous dispersion binder for a dye-donor element which will avoid environmental hazards.

These and other objects are achieved in accordance with this invention which comprises a dye-donor element for thermal dye transfer comprising a support having thereon a dye layer comprising an image dye dispersed in a binder, and wherein the binder has been coated from an aqueous solution and consists essentially of a hydrophilic polymer which has been set.

A hydrophilic polymer which has been set is one which is "settable" when coated, i.e., its viscosity vs. temperature curve shows a discontinuity due to formation of a three-dimensional network at this setting point of the binder.

Settable hydrophilic polymers which are useful in the invention include, for example, gelatin; thermoreversible materials that gel on cooling, e.g., corn and wheat starch, agar and agarose materials, xanthan gums, and certain polymers derived from acrylamides and methacrylamides as disclosed in U.S. Pat. Nos. 3,396,030 and 2,486,192; thermoreversible materials that gel on heating, e.g., certain polyoxyethylene-polyoxpropylenes as disclosed by I. R. Schmolka in J. Am. Oil Chem. Soc., 1977, 54, 110 and J. Rassing, et al., in J. of Molecular Liquids, 1984, 27, 165; some polysaccharides; and polymers with a hydrophilic group from a water-soluble ionic vinyl monomer and a hydrophobic group from an acrylamide or methacrylamide as disclosed in U.S. Ser. No. 742,784, of Roberts et al., filed Aug. 8, 1991, now abandoned.

By use of the invention, substantial improvements in uniformity in dye transfers can be obtained. Also, since the coating systems are aqueous, environmental hazards are reduced since organic solvents are not used.

The hydrophilic polymer which has been set which is used in the invention can be employed at a coverage of from about 0.2 to about 5 $g/m^2$.

Any image dye can be used in the dye-donor employed in the invention provided it is transferable to the dye-receiving layer by the action of the laser. Especially good results have been obtained with sublimable dyes such as anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

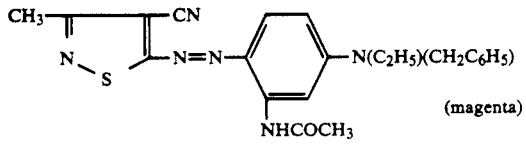
(magenta)

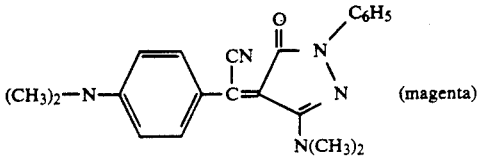
(magenta)

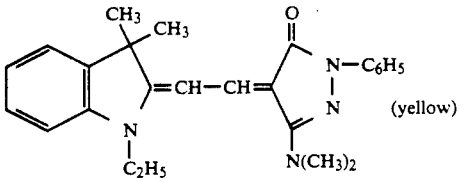
(yellow)

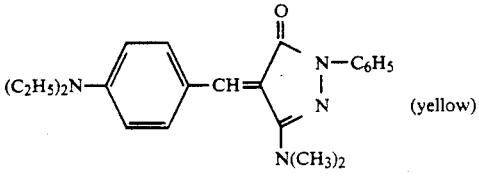
(yellow)

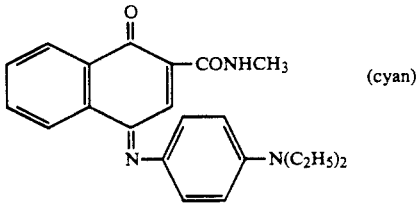
(cyan)

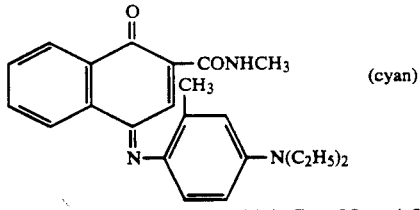
(cyan)

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 g/m$^2$ and are preferably hydrophobic.

Any material can be used as the support for the dye-donor element of the invention provided it is dimensionally stable and can withstand the heat of the laser or thermal head. Such materials include polyesters such as poly(ethylene terephthalate); polyamides; polycarbonates; cellulose esters such as cellulose acetate; fluorine polymers such as polyvinylidene fluoride or poly(tetrafluoroethylene-cohexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 200 μm and may also be coated with a subbing layer, if desired, such as those materials described in U.S. Pat. Nos. 4,695,288 or 4,737,486.

The reverse side of the dye-donor element may be coated with a slipping layer to prevent the printing head from sticking to the dye-donor element. Such a slipping layer would comprise either a solid or liquid lubricating material or mixtures thereof, with or without a polymeric binder or a surface active agent. Preferred lubricating materials include oils or semi-crystalline organic solids that melt below 100° C. such as poly(vinyl stearate), beeswax, bayberry wax, candelilla wax, carnauba was, ceresine was, Japan wax, montan wax, ouricury wax, rice bran wax, paraffin wax, microcrystalline wax, perfluorinated alkyl ester polyethers, polycaprolactone, silicone oils, poly(tetrafluoroethylene), carbowaxes, poly(ethylene glycols), or any of those materials disclosed in U.S. Pat. Nos. 4,717,711; 4,717,712; 4,737,485; and 4,738,950, and EP 285,425, page 3, lines 25–35. The waxes may be used in combination with silicone oils as mixtures or the waxes may be used to microencapsulate the silicone oils. Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, an ivory paper, a condenser paper or a synthetic paper such as DuPont Tyvek ®. Pigmented supports such as white polyester (transparent polyester with white pigment incorporated therein) may also be used. The dye-receiving element may also comprise a solid, injection-molded material such as a poly-carbonate, if desired.

The dye image-receiving layer may comprise, for example, a polycarbonate, a polyurethane, a polyester, polyvinyl chloride, poly(styrene-co-acrylonitrile), polycaprolactone, a poly(vinyl acetal) such as poly(vinyl alcohol-co-butyral), poly(vinyl alcohol-co-benzal), poly(vinyl alcohol-co-acetal) or copolymers or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only the dye thereon as described above or may have alternating areas of other different dyes, such as sublimable cyan and/or magenta and/or yellow and/or black or other dyes. Such dyes are disclosed in U.S. Pat. Nos. 4,541,830, 4,541,830, 4,698,651, 4,695,287; 4,701,439, 4,757,046, 4,743,582, 4,769,360 and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of cyan, yellow and a dye as described above which is of magenta hue, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCSOO1), a TDK Thermal Head F415 HH7-1089 or a Rohm Thermal Head KE 2008-F3.

A laser may also be used to transfer dye from the dye-donor elements of the invention. When a laser is used, it is preferred to use a diode laser since it offers substantial advantages in terms of its small size, low cost, stability, reliability, ruggedness, and ease of modulation. In practice, before any laser can be used to heat a dye-donor element, the element must contain an infrared-absorbing material, such as carbon black or cyanine infrared absorbing dyes as described in U.S. Pat. No. 4,973,572, or other materials as described in the following U.S. Pat. Nos.: 4,948,777, 4,950,640, 4,950,639, 4,948,776, 4,948,778, 4,942,141, 4,952,552, 5,036,040, and 4,912,083, the disclosures of which are hereby incorporated by reference. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat.

Lasers which can be used to transfer dye from dye-donors employed in the invention are available commercially. There can be employed, for example, Laser Model SDL-2420-H2 from Spectra Diode Labs, or Laser Model SLD 304 V/W from Sony Corp.

A thermal printer which uses the laser described above to form an image on a thermal print medium is described and claimed in copending U.S. application Ser. No. 451,656 of Baek and DeBoer, filed Dec. 18, 1989, now U.S. Pat. No. 5168288 the disclosure of which is hereby incorporated by reference.

A thermal dye transfer assemblage of the invention comprises a) a dye-donor element as described above, and b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed three times using different dye-donor elements. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

The first magenta dye illustrated above was dispersed in an aqueous medium containing the following surfactant: A2 Triton ® X-200 (Union Carbide Corp.). The exact formulation is shown in Table 1

TABLE 1

| COMPONENT | QUANTITY (grams) |
|---|---|
| Magenta Dye | 250 |
| 18.2% aq. Triton ® X-200 A2 Dispersing Agent | 275 |
| Distilled Water | 476 |

The formulation, as shown in Table I, was milled at 16° C. in a 1-liter media mill (Model LME1, Netzsch Inc.) filled to 75% by volume with 0.4 to 0.6 mm zirconia silica medium (obtainable from Quartz Products Corp., SEPR Division, Plainfield N.J.). The slurry was milled until a mean near infrared turbidity measurement indicated the particle size to have been less than or equal to 0.2 μm by discrete wavelength turbidimetry. This corresponded to a milling residence time of 45–90 minutes.

An aqueous carbon black (infrared-absorbing species) dispersion was prepared in a similar manner according to the formulation shown in Table II.

TABLE II

| Carbon Black Dispersion | |
|---|---|
| COMPONENT | QUANTITY (grams) |
| Carbon Black (Black Pearls 430 from Cabot Chemical Co.) | 200 |
| 18.2% aq. Triton ® X-200 A2 Dispersing Agent | 165 |
| Distilled Water | 635 |

Samples 1–4 (No Carbon Black)

A poly(ethylene terephthalate) support was coated with 0.57 g/m$^2$ of the magenta dye dispersion, and 1.08 g/m$^2$ of de-ionized bovine gelatin (Type IV), coated from water at 3.83% solids.

Another poly(ethylene terephthalate) support was coated with 0.57 g/m$^2$ of the magenta dye dispersion, and 1.08 g/m$^2$of hydrolyzed poly(vinyl alcohol), coated from water at 3.83% solids.

Samples 5–8 (Containing Carbon Black)

A poly(ethylene terephthalate) support was coated with 0.57 g/m$^2$ of the magenta dye dispersion, 0.22 g/m$^2$ of the carbon black dispersion, and 1.08 g/m$^2$ of de-ionized bovine gelatin (Type IV), coated from water at 4.325 % solids.

Another poly(ethylene terephthalate) support was coated with 0.57 g/m$^2$ of the magenta dye dispersion, 0.22 g/m$^2$ of the carbon black dispersion, and 1.08 g/m$^2$ of hydrolyzed poly(vinyl alcohol), coated from water at 4.325 % solids.

Within each of the sample series, the dye dispersion was used with either binder in the settable as well as in the non-set state. Setting of the gelatin was accomplished by an initial chill to 4.4° C. prior to drying (23.9° C. to 60° C.). The gelatin was not chilled prior to drying at 60° C. for those test runs where non-settable gelatin was to be used. The poly(vinyl alcohol) binder is unaffected by chilling conditions.

A "mottle index" was used as measure of the dye dispersion uniformity. This index was determined for the above donor samples using a Tobias Model MTI mottle tester (see P. E. Tobias et al., TAPPI Journal, vol. 72, No. 5, 109–112 (1989)). The donor samples were affixed to a piece of white reflective material which was then taped to the drum of the mottle tester. Sixty-four data readings were averaged for each data point, and each scan of the sample comprised 333 data points. Twenty scans were made of each donor over an area of 50 mm×33 mm, with the long dimension perpendicular to the rotating direction. The mottle tester calculates a mottle index for each scan of a 20-scan analysis of the sample. Three such samples were analyzed in this way for each donor coating type, and the mottle index listed in Table III below represents the average of 60 overall scans for each particular donor.

TABLE III

| Sample | Binder | Carbon in Donor | Chill Before Drying | Donor Mottle Index |
|---|---|---|---|---|
| 1 | Gelatin | No | Yes | 23 |
| 3 | PVA | No | Yes | 50 |
| 6 | Gelatin | No | No | 70 |
| 8 | PV | No | No | 49 |
| 2 | Gelatin | Yes | Yes | 71 |
| 4 | PVA | Yes | Yes | 255 |
| 7 | Gelatin | Yes | No | 434 |
| 9 | PVA | Yes | No | 226 |

The data shown in Table III illustrate the marked improvement in coating quality achieved by using a settable binder as compared to PVA in the image dye dispersion (the lower the value of the mottle index, the more uniformly dispersed is the dye in the dye-binder layer of the donor).

EXAMPLE 2

The dye-donor element of Sample 2 above, (containing carbon and gelatin which was set), was used to prepare an image as described below.

An intermediate dye-receiving element was prepared by coating on an unsubbed 100 μm thick poly(ethylene terephthalate) support a layer of crosslinked poly(styrene-co-divinylbenzene) beads (14 micron average diameter) (0.11 g/m$^2$), triethanolamine (0.09 g/m$^2$) and DC-510® Silicone Fluid (Dow Corning Company) (0.01 g/m$^2$) in a Butvar® 76 binder, a poly(vinyl alcohol-co-butyral), (Monsanto Company) (4.0 g/m$^2$) from 1,1,2-trichloroethane or dichloromethane.

Magenta dye images were printed as described below from dye-donors onto a receiver using a laser imaging device as described in U.S. Pat. No. 4,876,235. The laser imaging device consisted of a single diode laser connected to a lens assembly mounted on a translation stage and focused onto the dye-donor layer.

The dye-receiving element was secured to the drum of the diode laser imaging device with the receiving layer facing out. The dye-donor element was secured in face-to-face contact with the receiving element.

The diode laser used was a Spectra Diode Labs No. SDL-2430-H2, having an integral, attached optical fiber for the output of the laser beam, with a wavelength of 816 nm and a nominal power output of 250 milliwatts at the end of the optical fiber. The cleaved face of the optical fiber (100 microns core diameter) was imaged onto the plane of the dye-donor with a 0.33 magnification lens assembly mounted on a translation stage giving a nominal spot size of 33 microns and a measured power output at the focal plane of 115 milliwatts.

The drum, 312 mm in circumference, was rotated at 500 rev/min and the imaging electronics were activated. The translation stage was incrementally advanced across the dye-donor by means of a lead screw turned by a microstepping motor, to give a center-to-center line distance of 14 microns (714 lines per centimeter, or 1800 lines per inch). For a continuous tone stepped image, the current supplied to the laser was modulated from full power to 16% power in 4% increments. Maximum transfer density can be increased at the expense of printing speed by slowing the drum rotation while keeping all other operating parameters constant.

After the laser had scanned approximately 12 mm, the laser exposing device was stopped and the intermediate receiver was separated from the dye donor. The intermediate receiver containing the stepped dye image was laminated to Ad-Proof Paper® (Appleton Papers, Inc.) 60 pound stock paper by passage through a pair of rubber rollers heated to 120° C. The polyethylene terephthalate support was then peeled away leaving the dye image and polyvinyl alcohol-co-butyral firmly adhered to the paper. The paper stock was chosen to represent the substrate used for a printed ink image obtained from a printing press.

The Status A green density was read over a range of laser power settings. The following results were obtained:

TABLE IV

| Laser Power | Reflection Density Status A Green |
|---|---|
| Full | 2.37* |
| 90% | 0.64 |
| 80% | 0.62 |
| 70% | 0.34 |
| 61% | 0.19 |
| 51% | 0.17 |
| <41% | 0.16 (D min) |

*Some sticking of donor to receiver resulted in artificially increased density.

The above results show that the dye-donor elements of the invention function in a laser-induced thermal dye transfer system to provide a range of densities.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a support having thereon a dye layer comprising an image dye dispersed in a polymeric material, the improvement wherein the polymeric material has been coated from an aqueous solution and consists essentially of a hydrophilic polymer which has been set.

2. The element of claim 1 wherein said hydrophilic polymer is gelatin.

3. The element of claim 1 wherein said dye-donor element also contains an infrared-absorbing material.

4. The element of claim 3 wherein said infrared-absorbing material is in said dye layer.

5. The element of claim 4 wherein said infrared-absorbing material is a dye.

6. In a process of forming a thermal dye transfer image comprising:

a) contacting at least one dye-donor element comprising a support having thereon a dye layer comprising an image dye dispersed in a polymeric material with a dye-receiving element comprising a support having thereon a polymeric dye image-receiving layer;

b) imagewise-heating said dye-donor element; and c) transferring a dye image to said dye-receiving element to form said thermal dye transfer image, the improvement wherein the polymeric material has been coated from an aqueous solution and consists essentially of a hydrophilic polymer which has been set.

7. The process of claim 6 wherein said hydrophilic polymer is gelatin.

8. The process of claim 6 wherein said dye-donor element also contains an infrared-absorbing material.

9. The process of claim 8 wherein said infrared-absorbing material is in said dye layer.

10. The process of claim 9 wherein said infrared-absorbing material is a dye.

11. In a thermal dye transfer assemblage comprising:

(a) a dye donor element comprising a support having thereon a dye layer comprising a dye dispersed in a polymeric material, and (b) a dye-receiving element comprising a support having thereon a dye image-receiving layer, said dye-receiving element being in superposed relationship with said dye-donor element so that said dye layer is in contact with said dye image-receiving layer, the improvement wherein the polymeric material has been coated from an aqueous solution and consists essentially of a hydrophilic polymer which has been set.

12. The assemblage of claim 11 wherein said hydrophilic polymer is gelatin.

13. The assemblage of claim 11 wherein said dye-donor element also contains an infrared-absorbing material.

14. The assemblage of claim 13 wherein said infrared-absorbing material is in said dye layer.

15. The assemblage of claim 14 wherein said infrared-absorbing material is a dye.

* * * * *